US006543944B2

(12) United States Patent
Horii et al.

(10) Patent No.: US 6,543,944 B2
(45) Date of Patent: Apr. 8, 2003

(54) WIRE DOT PRINTER HEAD AND WIRE DOT PRINTER USING THE SAME

(75) Inventors: Masami Horii, Tagata-gun (JP); Tetsuro Ichitani, Mishima (JP); Yasunobu Terao, Tagata-gun (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/905,866

(22) Filed: Jul. 17, 2001

(65) Prior Publication Data

US 2003/0016982 A1 Jan. 23, 2003

(30) Foreign Application Priority Data

Jul. 17, 2000 (JP) ..... 2000-215691

(51) Int. Cl.[7] ..... B41J 2/22; B41J 2/235

(52) U.S. Cl. ..... 400/124.01; 400/124.04; 400/124.12

(58) Field of Search ..... 400/124, 124.01, 400/124.02, 124.05, 124.04, 124.28, 124.29, 124.11, 124.12

(56) References Cited

U.S. PATENT DOCUMENTS

| | | | | |
|---|---|---|---|---|
| 4,437,775 A | | 3/1984 | Ochiai et al. | 400/124 |
| 4,441,828 A | | 4/1984 | Ochiai et al. | 400/124 |
| 4,447,166 A | | 5/1984 | Ochiai et al. | 400/124 |
| 4,602,301 A | | 7/1986 | Saito et al. | 360/69 |
| 4,624,589 A | * | 11/1986 | Ochiai et al. | 400/124 |
| 4,652,950 A | | 3/1987 | Ichitani et al. | 360/105 |
| 4,802,781 A | * | 2/1989 | Sheerer | 400/124 |
| 4,951,158 A | | 8/1990 | Ichitani | 358/451 |
| 5,009,528 A | | 4/1991 | Horii et al. | 400/124 |
| 5,096,313 A | | 3/1992 | Horii | 400/124 |
| 5,123,759 A | | 6/1992 | Horii et al. | 400/124 |
| 5,163,761 A | | 11/1992 | Horii et al. | 400/124 |

FOREIGN PATENT DOCUMENTS

| | | |
|---|---|---|
| JP | 54-24115 | 2/1979 |
| JP | 2563863 | 9/1996 |
| JP | 2958010 | 7/1999 |

* cited by examiner

*Primary Examiner*—Huan Tran
*Assistant Examiner*—An H. Do
(74) *Attorney, Agent, or Firm*—Oblon, Spivak, McClelland, Maier & Neustadt, P.C.

(57) ABSTRACT

A wire dot printer head including a yoke, cores arranged in an annular form on the yoke, coils combined with the cores so as to fit the cores, armatures supported so as to be raised or lowered in respect to the cores, wires supported at the free ends of the armatures in such a way that they may be driven and displaced, and an extremity end guide having guide holes for independently and slidably supporting the extremity ends of the wires to arrange them. When the moving direction of the wire dot printer head is as a main scanning direction, the guide holes of the extremity end guide are arranged along an arc curved only in direction of the sub-scanning direction so as to cause the arrangement positions in the main scanning direction to be made different.

8 Claims, 6 Drawing Sheets

WIRE DOT PRINTER HEAD AND WIRE DOT PRINTER USING THE SAME

CROSS REFERENCE TO RELATED APPLICATION

The present application is based on Japanese Priority Document 2000-215691 filed on Jul. 17, 2000, the content of which is incorporated herein by reference.

BACKGROUND OF THE INVENTION

1. Field of the Invention

The present invention relates to a wire dot printer and a wire dot printer using the same.

2. Discussion of the Background

There is already provided in the related art a wire dot printer head in which a plurality of cores and yokes arranged in an annular shape are integrally formed by magnetic material, a coil is fitted to each of these cores, a plurality of armatures having wires fixed at their extremity ends with means such as a brazing and the like are arranged in a radial form, and supported so as to be raised or lowered in respect to the cores, the extremity ends of the wires are arranged in rows by the extremity end guides to be slidably supported. Such a wire dot printer head as above is moved in a main scanning direction in parallel with the platen while being mounted on a carrier, the specified coil is excited during its moving process to drive the armature and then the extremity ends of the wires are struck against the printing medium on the platen to perform a printing operation.

As shown in FIG. 6, an extremity end guide 100 having a plurality of guide holes 100*a* arranged on a linear line of one row is applied and when the extremity ends of the wires are arranged in rows by the extremity end guide 100 on a linear line extending along a sub-scanning direction Y crossing at a right angle with a main scanning direction X acting as a moving direction of the wire dot printer head, for example, when an alpha-numerical letter of "I" is printed, the wires arranged in the sub-scanning direction Y must be driven at once. With such an arrangement as above, there occurs a problem that the capacity of power supply is increased and noise generated when the wires strike against the platen is increased.

In view of this fact, as shown in FIG. 7, there is provided a system in which an extremity end guide 101 having a plurality of guide holes 101*a* divided into two rows and arranged in a zig-zag form is applied, the extremity ends of the wires are arranged in two-divided rows along the sub-scanning direction Y, the extremity ends of the wires are arranged in a zig-zag form in such a way that the arranging positions of the wires in the first row and the wires in the second row along the sub-scanning direction Y may be displaced only by a pitch corresponding to a half of a diameter of the wire, and even in the case that the letter of "I" is to be printed, after the entire wires in the first row are driven, the wire dot printer head is moved in the main scanning direction X only by a space between the wires in the first row and the wires in the second row, the entire wires in the second row are driven to cause one character or letter to be printed in two separate stages (refer to the gazette of Japanese Patent Laid-Open No. Sho 54-24115).

Further, there is also provided a system enabling the similar object to be accomplished in which as shown in FIG. 8, an extremity end guide 102 having a plurality of guide holes 102*a* arranged along two arcs is used and the extremity ends of the wires are arranged along the two arcs (refer to the gazette of Patent No. 2958010). Further, although not shown, there are provided two proposals, one of them being such that the extremity ends of the wires are arranged along a contour of rhombus and the other being set such that the extremity ends of the wires are arranged on a linear line inclined in a synthetic direction between the sub-scanning direction and the main scanning direction.

In the case of the structure in which the extremity ends of the wires are divided into to rows and arranged in a zig-zag form or in the case of the structure in which the extremity ends of the wires are arranged along the two arcs or arranged along a contour of rhombus, a work for inserting the extremity ends of the wires into the respective guide holes formed in the extremity end guide while bending the wires which is to be apt to extend straight is quite troublesome. This is due to the fact that it is quite hard to adjust a degree of bending to keep the space of specified size and specified shape inside the plurality of bundled wires when the plurality of wires are bent to be bundled from outside.

In the case that the number of intermediate guides supporting the intermediate part of the wire between the rear end of the wire fixed to the armature and the extremity end guide for supporting the extremity end of the wire is increased, it is possible to guide the wire in sequence from the intermediate guide at the armature side to a subsequent intermediate guide in sequence. However, in the case where the number of intermediate guides is increased and the extremity ends of the wires are to be accurately guided into the intermediate guide, the independent guide hole must be formed accurately at the intermediate guide and its cost will be increased. Further, since a load is applied from the intermediate guide to the wires, so the wires are prevented to move in high speed.

Further, in the case of the structure in which the extremity ends of the wires are arranged along the two arcs or arranged along a contour of rhomb, the number of wires having different arrangement position in the main scanning direction is increased, so that in order to drive the coil corresponding to the wire having different arrangement position in the main scanning direction under a different timing, more number of control circuits are required and the voltage applying control becomes complicated. In particular, in the case of structure in which the extremity ends of the wires are arranged on a linear line inclined in a synthetic direction between the sub-scanning direction and the main scanning direction, the positions of main scanning directions of all the wires are different from each other, whereby the number of control circuits corresponding to the number of wires is required and the voltage applying control becomes most complicated.

SUMMARY OF THE INVENTION

It is an object of the present invention to keep a power supply capacitance, reduce noise, improve assembling workability and reduce cost.

The object of the present invention is achieved by the novel wire dot printer head and wire dot printer of the present invention.

According to the novel wire dot printer head of the present invention, the extremity ends of a plurality of wires supported at a free end of an armature so as to be driven and displaced are slidably supported by the guide holes formed at the extremity end guides in an independent manner and arranged. In the case where the moving direction of the wire dot printer head is as the main scanning direction, the guide holes at the extremity end guides are arranged along the arc (in a continuous manner) curved only in one direction of the sub-scanning direction so as to cause the arrangement position in the main scanning direction to be different while satisfying a condition in which all the arrangement positions of the sub-scanning direction crossing at a right angle with the main scanning direction are different.

According to the novel wire dot printer of the present invention, the free end of the armature is provided with a wire dot printer head for supporting a plurality of wires to be driven. The extremity ends of the plurality of wires are slidably supported by the guide holes arranged at the extremity end guides in an independent manner and arranged. In the case where the moving direction of the wire dot printer head is applied as the main scanning direction, the guide holes at the extremity end guides are arranged along the arc curved only in one direction of the sub-scanning direction (in a continuous manner) so as to make the arrangement position in the main scanning direction different while satisfying a condition in which all the arrangement positions of the sub-scanning direction crossing at a right angle with the main scanning direction are different. A voltage is applied to the coil for driving respective wires in response to the arrangement position of the wire extremity ends in the main scanning direction while changing its timing.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
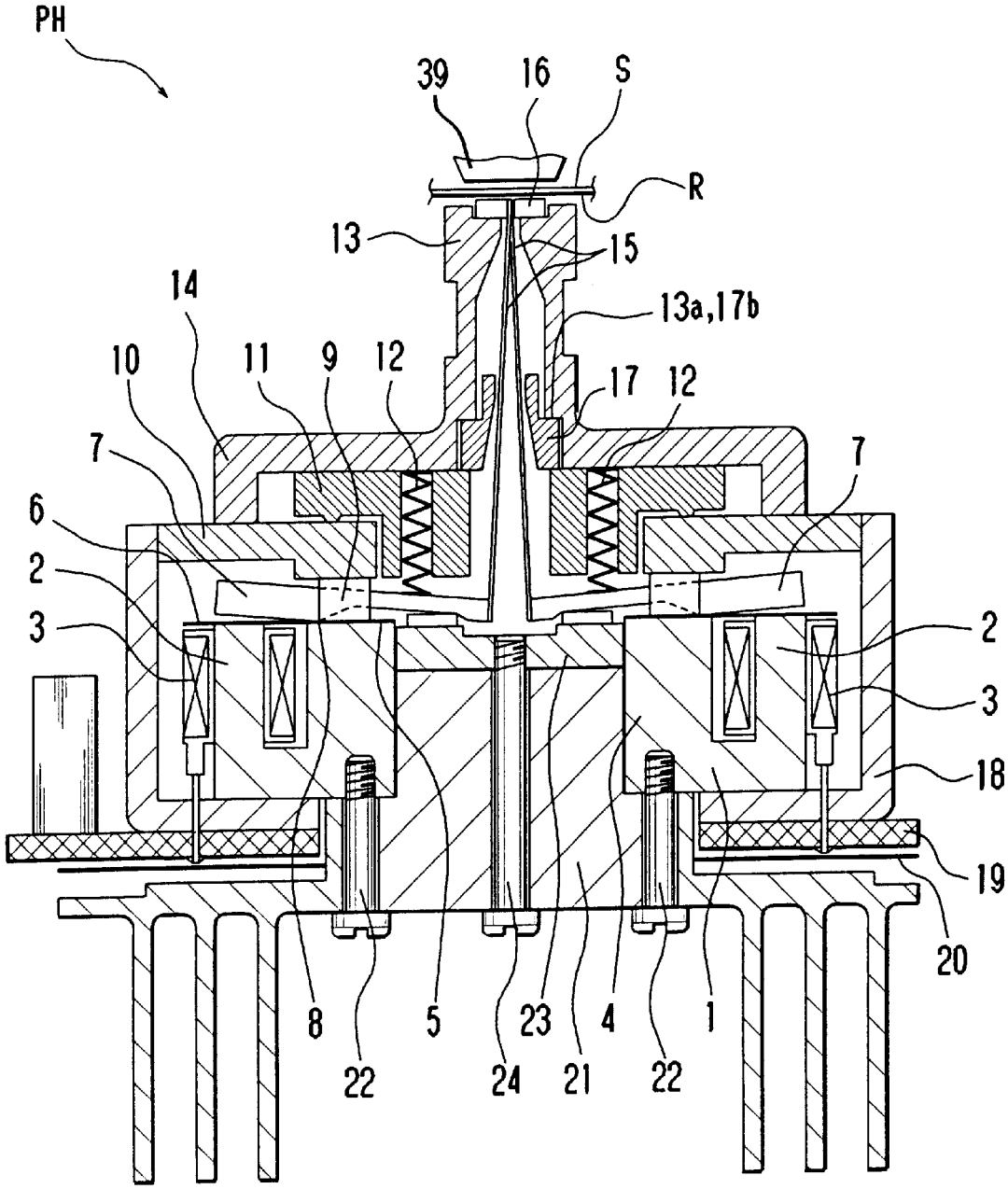
FIG. 1 is a side elevational view in longitudinal section for showing a configuration of the wire dot printer head in one preferred embodiment of the present invention.

Referring now to FIG. 1, a schematic configuration of a wire dot printer head PH in one preferred embodiment of the present invention will be described as follows. Reference numeral 1 denotes a yoke. A plurality of cores 2 (nine cores in this preferred embodiment) are arranged in an annular form at the yoke 1, and they are integrally formed. It is of course apparent that the cores may be formed by another member and fixed to the yoke 1. Coils 3 are fitted to the cores 2. A part of an end surface 5 of a cylindrical wall 4 formed inside the yoke 1 serves as a fulcrum point 8 supporting the armature 7 through a film 6 so as to be raised or lowered.

In addition, a plurality of studs 9 passing through the intermediate part between the film 6 and the armature 7 are vertically installed at the end surface 5 of the cylindrical wall 4 of the yoke 1, and a supporting plate 10 is abutted against the end surfaces of these studs 9. An armature guide 11 is abutted against the outer surface of the supporting plate 10, and armature springs 12 for biasing the armature 7 in a returning direction are supported at the armature guide 11.

Further, a flange 14 of a nose 13 is abutted against the outer surface of the armature guide 11. The nose 13 is provided with an extremity end guide 16 for slidably supporting the extremity end of the wire 15 brazed at the end part of the armature 7, and with a vibration-proof guide 17 where the intermediate part of the wire 15 passes. The yoke 1, the supporting plate 10, the armature guide 11 and the flange 14 of the nose 13 are assembled with screws not shown.

The aforesaid yoke 1 is stored in a housing 18 where the supporting plate 10 is fitted to one end thereof. The outside part of the bottom surface of the housing 18 is provided with a base plate 19 to which the coils 3 are connected and with an insulating film 20. Reference numeral 21 denotes a heat sink, which is partially fitted while being in contact with the inner circumferential surface of the cylindrical wall 4, and fixed to the yoke 1 by screws 22. An armature stopper 23 for defining a returning position of the armature 7 is fixed by a screw 24.

Then, operation of the wire dot printer head PH will be described as follows. When the coils 3 are electrically excited, a magnetic flux flows at the core 2, the armature 7 and the yoke 1, so that the armature 7 is retracted toward the core 2 around the fulcrum point 8 against urging force of the armature spring 12 and the wire 15 strikes against the platen 39 through the ink ribbon R and the sheet S. Then, a printing operation is performed.

A period in which the coils 3 are electrically excited is instantaneous and the armature 7 returns by a reaction force where the wire 15 may receive from the platen 39 and the biasing force of the armature spring 12. At the time of this returning operation, the armature 7 abuts against the armature stopper 23 to define the returning position.

Figure 2:
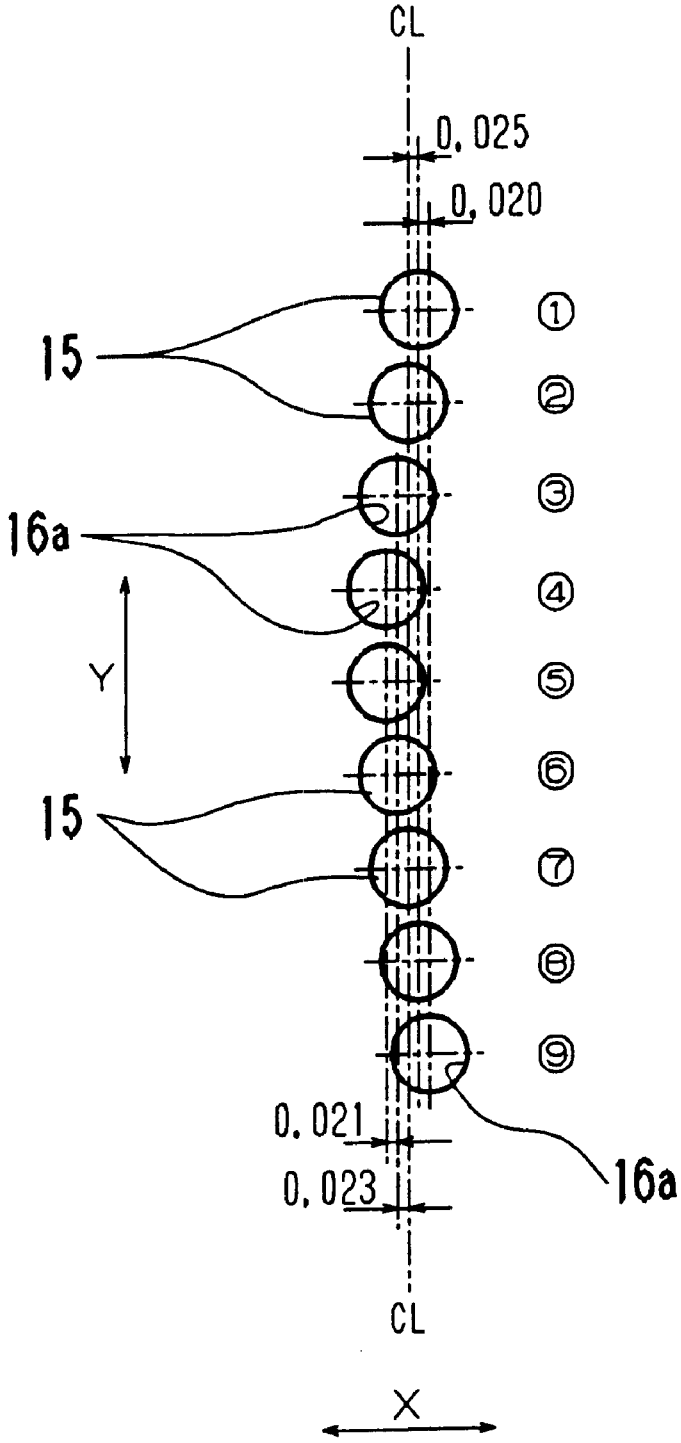
FIG. 2 is an illustration for showing an arrangement pattern of guide holes and extremity ends of wires.

A feature of the wire dot printer head PH of the present invention will be described as follows. FIG. 2 is an illustration for showing an arrangement pattern of the extremity ends of the wires 15. The circles indicating the extremity ends of the wires 15 are also arrangement patterns of the guide holes 16*a* formed at the extremity end guides 16. Reference codes ① to ⑨ described in this figure denote an order of arrangement of the wires 15 and the guide holes 16*a*. In addition, an arrow X in this figure denotes a main scanning direction acting as a moving direction of the wire dot printer head PH, an arrow Y denotes a sub-scanning direction crossing at a right angle with the main scanning direction and the sub-scanning direction Y is also a feeding direction of the sheet S (refer to FIG. 1).

Then, the guide holes 16*a* of the extremity end guides 16 are arranged continuously in one row along an imaginary arc in such a way that they satisfy a condition in which the arrangement positions in the sub-scanning direction Y are all different and the arrangement positions in the main scanning direction X are made different.

Further, the present invention will be described in detail as follows, wherein the guide holes 16*a* are classified into five groups which are less than a total number of the guide holes 16*a* (nine holes), i.e. a group of ①⑧, a group of ②⑦, a group of ③⑥, a group of ④⑤ and a group of ⑨, and the arrangement positions in the main scanning direction X are made different in a unit of the classified group.

That is, a center line CL drawn in parallel with the sub-scanning direction Y in FIG. 2 is a linear line passing through the center of the arrangement space of the cores 2. In other words, in the case that the cores 2 are arranged in an annular form, this is a linear line passing through the center of radius of a circle formed by the lines passing through the centers of all cores 2. The guide holes 16*a* in the group ②⑦ have their centers arranged on the center line CL, the guide holes 16*a* in the group ①⑧ have their centers arranged on the linear line spaced apart by 0.025 mm toward the right side of the main scanning direction X from the center line CL, and the guide holes 16*a* in the group A have their centers arranged on the linear line spaced apart by 0.020 mm toward the right side of the main scanning direction X from the center line CL of the guide holes 16*a* in the group ①⑧. The guide holes 16*a* in the group ③⑥ have their centers arranged on the linear line spaced apart by 0.023 mm toward the left side of the main scanning direction from the center line CL, and the guide holes 16*a* in the group ④⑤ have their centers arranged on the linear line spaced apart by 0.021 mm toward the left side of the main scanning direction X from the centers of the guide holes 16*a* in the group ③⑥. In this way, displacement spaces of the guide holes 16*a* toward the main scanning direction X are defined in non-uniform manner.

The wires 15 are adjacent to each other at the extremity ends supported at the guide holes 16*a* of the extremity end guides 16, and the coils 3 and the cores 2 for driving the wires 15 kept in the same group are spaced apart from each other while the center of the arrangement space of the coils 2 (also the center of the yoke 1 in this example) being applied therebetween.

Figure 3:
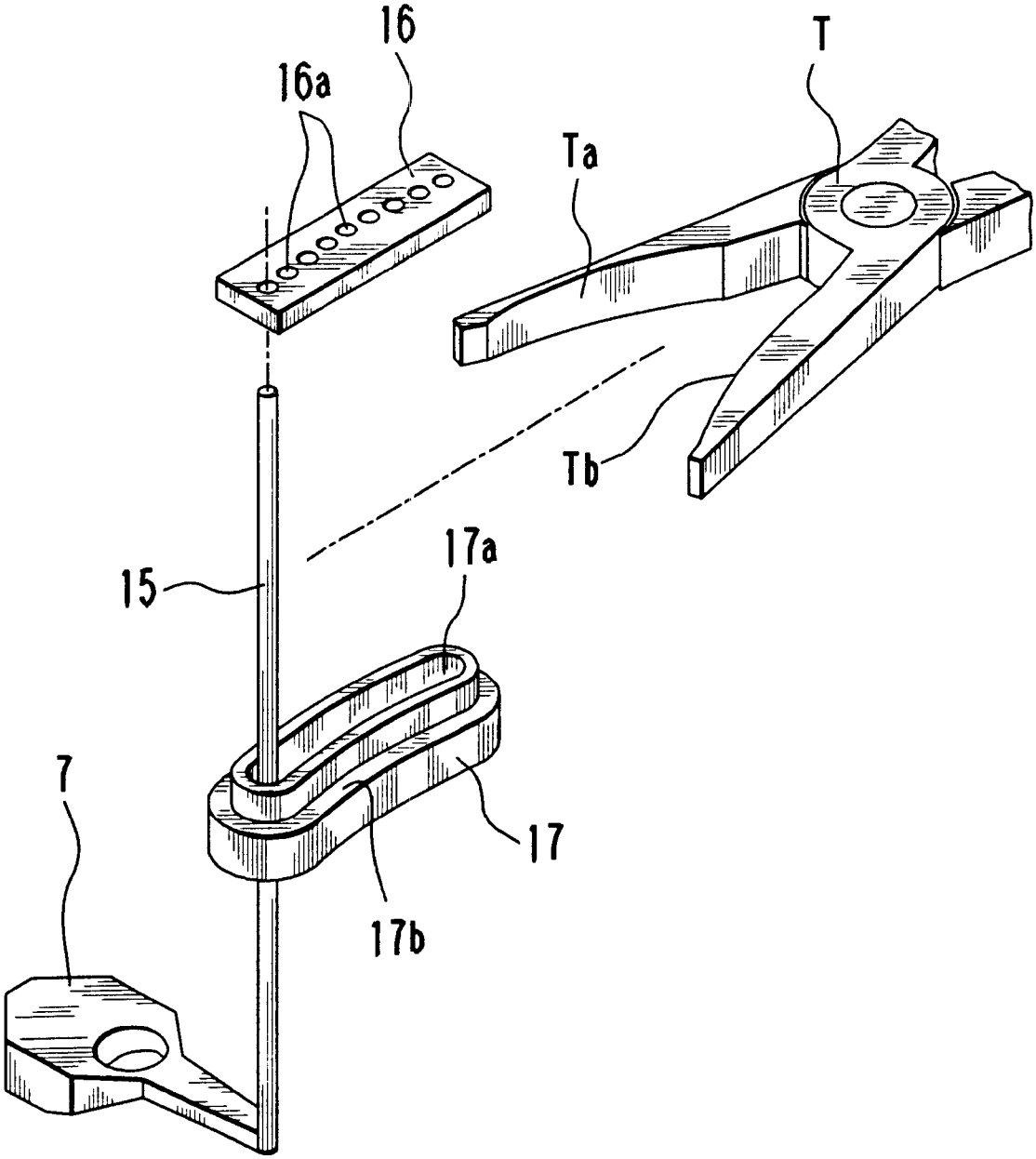
FIG. 3 is an exploded perspective view for illustrating a work for passing the extremity end of the wire through an extremity end guide.

As shown in FIG. 3, the vibration-proof guide 17 is a member for restricting any vibration of the wires 15 at the time of applying an impact and is provided with one large opening 17*a* for passing the wire 15 with a sufficient space. This opening 17*a* has an oval hole with an arcuate section and a taper narrowed from the rear end of the wire 15 toward the extremity end is formed at the inner surface (refer to FIG. 1). Accordingly, the wire 15 does not receive any pressure from the vibration-proof guide 17 under its standstill state.

In addition, although the vibration-proof guide 17 is assembled only through a mere fitting to the inside part of the nose 13, the step part 17*b* (refer to FIG. 3) is formed in such a way that the extremity end guide 16 is narrowed to keep a constant fitted depth. The step 13*a* to which the step part 17*b* is abutted is also formed at the nose 13 (refer to FIG. 1). As shown in FIG. 1, the end surface of the vibration-proof guide 17 at the side of the armature 7 is provided with an anti-removal from the nose 13 due to the fact that it is abutted against the armature guide 11 after assembling of it.

As described above, the guide holes 16*a* of the extremity end guide 16 are arranged continuously along an arc in such a way that the arrangement positions in the main scanning direction X are made different, as shown in FIG. 2, so that the extremity ends of the wires 15 are supported at the arrangement positions different from the main scanning direction X by the extremity end guide 16. With such an arrangement as above, even in the case where the letter of alpha-numerical "I", for example, is printed, all the wires 15 are not driven at once, thereby a capacitance of power supply can be reduced and noise may also be reduced.

In the preferred embodiment of the present invention, the guide holes 16*a* are classified into the less number (5) of groups than the total number (9), the arrangement positions in the main scanning direction X are made different in a unit of group, thereby the arrangement positions of the extremity ends of the wires 15 in the main scanning direction X are made different in a unit of group of the less number (5) than the total number (9) of the wires 15, so that five control circuits suffices for controlling the coils 3 corresponding to the wire 15 in each of the groups, and the coil voltage applying control can be conveniently simplified more as compared with the case that the nine control circuits are applied to control the coils 3 one by one while changing the timing.

In this case, the cores 2 holding the coils 3 driving the wires 15 having the same group are arranged in spaced-apart relation to face with the center (a center of yoke 1) of arrangement space of the cores 2 being kept therebetween, so that no magnetic interference may occur between the cores 2.

In addition, since the cores 2 are arranged in an annular form, the rear ends of the wires are also arranged in an annular form. On the other hand, the extremity ends of the wires 15 are arranged along an arc where its chord extends along the center line CL, so that, as to the wires 15 in ④⑤ arranged at the center part of the arc, for example, each of the rear ends of the wires 16 in these ④⑤ is fixed to the armature opposite to the cores facing to each other with the center line CL being as a boundary, whereby a difference in bending amount of the wires 15 in these ④⑤ becomes large.

However, in the preferred embodiment, as shown in FIG. 2, if the guide holes 16*a* are arranged along an arc, the guide holes 16*a* in ①⑨ arranged at both ends of the row and the guide holes 16*a* in ④⑤ arranged at the central part of the row are arranged at both sides with center line CL in the sub-scanning direction passing through the center of the arrangement positions of the cores 2 being as a boundary, whereby a difference in bending of the wires 15 different in response to the arrangement positions can be reduced. With such an arrangement as above, a difference in impact force of the wires 15 against the platen 39 is also reduced and it may contribute to improvement of printing quality.

In addition, since all the displacement spacings of the guide holes 16*a* in the main scanning direction are defined in unequal manner, the capacitance of power supply and noise can be reduced not only under a limited printing resolution degree but also under a plurality of resolution degree. For example, in the case of 180 dpi of the printing resolution, if the space of the all the guide holes 16*a* in the main scanning direction is 1/180 inch, the capacitance of power supply and the noise can not be reduced due to a synchronous driving of all the wires 15. However, in accordance with the present invention, even if the plurality of wires supported by the guide holes 16*a* having the space in the main scanning direction defined as 1/resolution degree are driven simultaneously, the wires 15 supported at other guide holes 16*a* are not driven concurrently. Accordingly, it is possible to reduce the capacitance of power supply and noise.

Further, even if the extremity ends of the wires 15 are arranged along the arc, they are arranged continuously in one row. Accordingly, the wires 15 are bundled by a tool such as a wrench or the like in such a way that the arrangement of the extremity ends of the wires 15 may form arc shape, whereby they may be easily guided into the guide holes 16*a* of the extremity end guides 16.

One example of the assembling method will be described. In the assembling step where the extremity ends of the wires 15 are passed through the guide holes 16*a* of the extremity end guides 16, the plurality of armatures 7 to which the wires 15 are brazed are arranged at the position opposite to the cores 2 in a radial manner within the same plane and the wires 15 being faced upward. Under this state, the opening 17*a* of the vibration-proof guide 17 under its unit form is fitted to the intermediate part of the wires 15. This state is indicated in FIG. 3. In FIG. 3, only one wire 15 is illustrated, although all the wires 15 are passed through the opening 17*a* of the vibration-proof guide 17. Then, the intermediate part of the wires 15 projected out of the opening 17*a* of the vibration-proof guide 17 is held by a tool.

In this example, the tool is a wrench T as shown in FIG. 3. This bench T has a concave surface Ta and a convex surface Tb where the extremity ends of the wires 15 are formed with a curvature corresponding to the arrangement of the guide holes 16*a* of the extremity end guide 16, and the plurality of wires 15 are arranged on the arc and held. A radius of curvature of each of the concave surface Ta and the convex surface Tb is defined in such a way that when the intermediate part of the wires 15 is held, the arrangement positions of the extremity ends of the wires 15 become equal to the arrangement positions of the guide holes 16*a*.

Then, under a state in which the intermediate part of the wires 15 projected out of the opening 17*a* of the vibration-proof guide 17 is held, the extremity end guide 16 is approached to the extremity ends of the wires 15 in such a way that the flange 14 of the nose 13 covers the armatures 7 arranged in a radial manner, whereby the extremity ends of the wires 15 can be easily passed through the guide holes 16*a*. In this case, insertion of the wires 15 into the guide holes 16*a* can be carried out more easily by forming the grooves substantially equal to a radius of the wire 15 at the inner surface of the concave surface Ta only by the number equal to that of the wires 15 or by forming the step for limiting a range of bundling the wires 15 such that the wires 15 at both ends may not be expanded out of the concave surface Ta.

An assembling method for passing the extremity ends of the wires 15 into the guide holes 16*a* of the extremity end guide 16 will be described. This method is a method in which the nose 13 formed with the opening (not shown) for exposing the intermediate part of the wires 15 is used. In this case, this method is carried out such that the wrench T is inserted at the opening of the nose 13 to hold a plurality of wires 15 as described above and the guided to the guide holes 16*a* of the extremity end guide 16.

Figure 4:
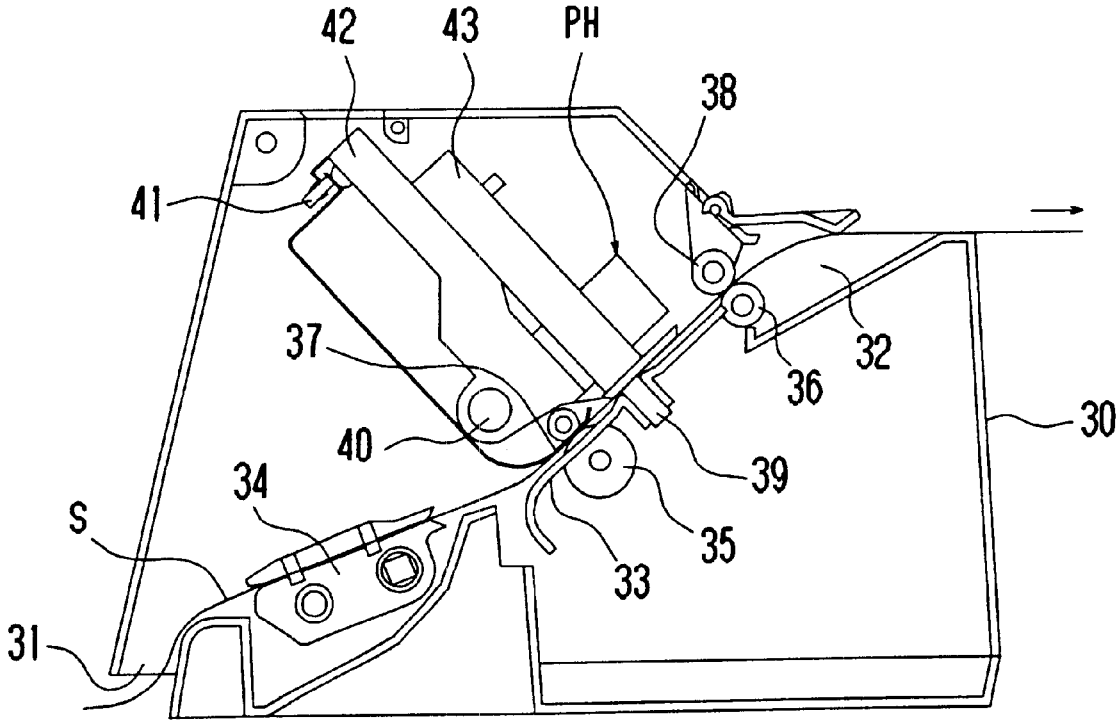
FIG. 4 is a side elevational view in longitudinal section for showing a schematic configuration of the wire dot printer having the wire dot printer head of the present invention mounted thereon.
Figure 5:
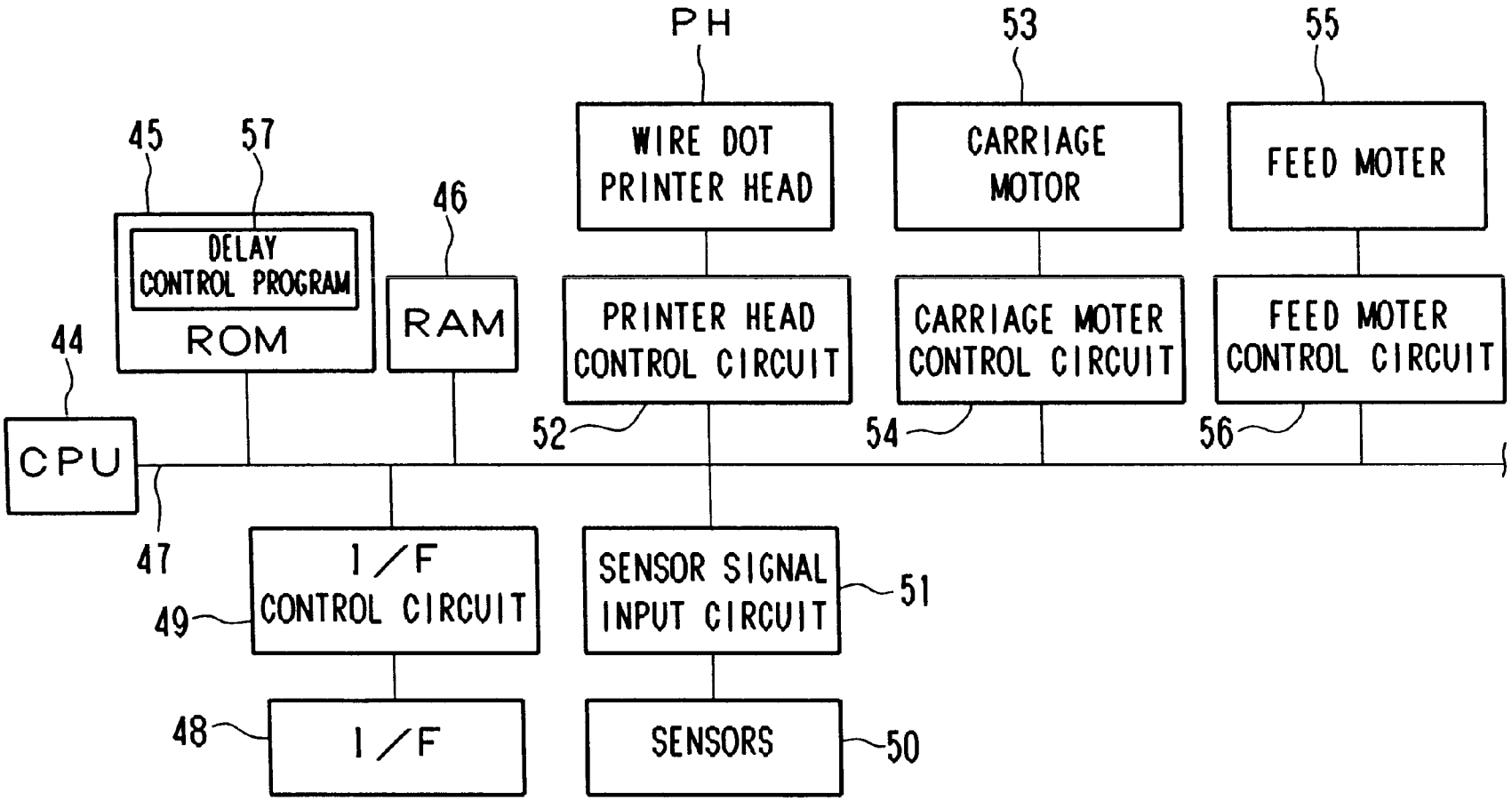
FIG. 5 is a block diagram for showing an electrical connecting structure of the wire dot printer.
Figure 6:
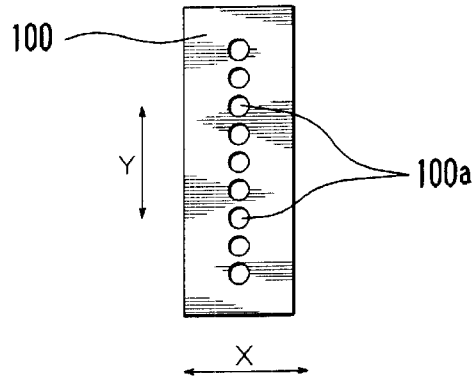
FIG. 6 is an illustrative view for showing the prior art extremity end guide.
Figure 7:
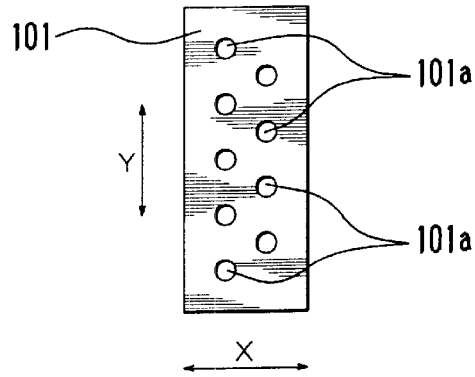
FIG. 7 is an illustrative view for showing the prior art extremity end guide.
Figure 8:
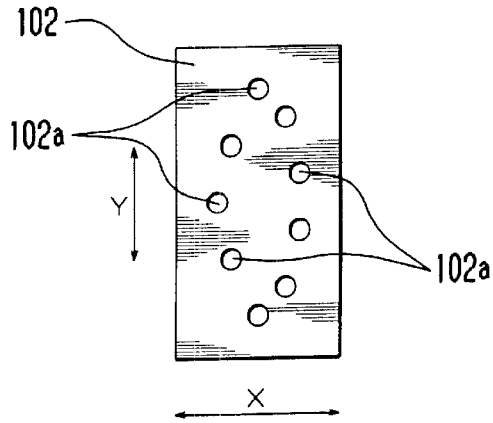
FIG. 8 is an illustrative view for showing the prior art extremity end guide.

Then, the configuration of the wire dot printer provided with the wire dot printer head PH described up to now will be described in reference to FIGS. 4 and 5. FIG. 4 is a side elevational view in longitudinal section for showing the schematic structure of the wire dot printer and FIG. 5 is a side elevational view in longitudinal section for illustrating the electrical connecting structure.

In FIG. 4, reference numeral 30 denotes a casing. This casing 30 is formed with a sheet transferring passage 33 subsequent from a sheet feeder port 31 to a sheet discharging port 32. This sheet transferring passage 33 is provided with a tractor 34, transfer rollers 35, 36 acting as sheet transferring means for transferring each of the sheets S. To these transferring rollers 35, 36 are in press contact with the pinch rollers 37, 38. In addition, a platen 39 is arranged between the transfer rollers 35, 36. A carrier 42 is supported above the sheet transferring passage 33 by a carrier shaft 40 and a carrier guide 41 in such a way that it may be moved in a main scanning direction along the longitudinal direction of the platen 39. To this carrier 42 is fixed the wire dot printer head PH. In addition, to the carrier 42 is removably attached a ribbon cassette 43 for feeding an ink ribbon between the platen 39 and the extremity end of the wire dot printer head PH.

Then, referring to FIG. 5, an electrical connecting structure will be described. CPU 44, ROM 45 and RAM 46 are connected by a system bus 47. Then, to the CPU 44 are connected via the system bus 47, an interface control circuit 49 for controlling the interface 48 communicating a signal with external equipment (not shown); a sensor control circuit 51 to which are connected various kinds of sensors 50 including a sheet sensor for outputting a signal in response to a transferring condition of the sheet S in the sheet transferring passage 33 and a carrier sensor for sensing a position of the carrier 42 and the like; a head control circuit 52 for controlling an operation of the wire dot printer head PH; a carrier motor control circuit 54 for controlling an operation of the carrier motor 53; and a transferring motor control circuit 56 for controlling an operation of the transferring motor 55 and the like.

The carrier motor can be rotated normally or in a reverse direction and is provided with a carrier driving mechanism (not shown) for converting the rotating motion to the linear motion and transmitting it to the carrier 42. In addition, the transferring motor 55 is connected to the rotating shafts for use in driving the tractor 34 and the transferring rollers 35, 36, respectively.

With such an arrangement as above, the sheet S is supplied by the tractor 34 and transferred by the transferring rollers 35, 36 and the pinch rollers 37, 38. The transferring of the sheet S is stopped when the printing position of the sheet S reaches the wire dot printer head PH, the carrier motor 53 is driven to cause the carrier 42 to be moved in the main scanning direction together with the wire dot printer head PH and during this process, the coils 3 are electrically energized by the head control circuit 52 in response to the image data, whereby the desired image is printed on the sheet S.

The wire dot printer head PH mounted on the wire dot printer as described above is made such that as shown in FIG. 2, the extremity ends of the wires 15 are arranged along an arc in such a way that the arrangement positions are made different in main scanning direction X, so that in the case where all the wires 15 are driven to print the letter of alpha-numerical "I", for example, while the wire dot printer head PH is being moved in the main scanning direction, at first, voltage is applied to the coils 3 for driving wires 15 in the group ④⑤, subsequently, applying of voltage is carried out in delay in an order of the group ③⑥, the group ②⑦, the group ①⑧ and the group ⑨. This controlling operation is accomplished such that since the arrangement positions of the extremity ends of the wires 15 are defined as the design value, the delay control program 57 for setting in sequence a timing for applying voltage to the coils 3 is stored in ROM 45 and the CPU 44 controls the operation of the head control circuit 52 in response to the delay control program while monitoring a transferring position of the carrier 42. This series of control operation may realize a voltage applying control means for performing voltage applying to the coils 3 while changing the timing in response to the arrangement positions of the extremity ends of the wires 15 in the main scanning direction.

Obviously, numerous modifications and variations of the present invention are possible in light of the above teachings. It is therefore to be understood that within the scope of the appended claims, the invention may be practiced otherwise than as specifically described herein.

What is claimed is:

1. A wire dot printer head, comprising:

a yoke;

a plurality of cores arranged in an annular form on the yoke;

a plurality of coils combined with the cores so as to fit the cores;

a plurality of armatures supported so as to be raised or lowered in respect to the cores;

a plurality of wires supported at the free ends of the armatures in such a way that they may be driven and displaced; and an extremity end guide having a plurality of guide holes for independently and slidably supporting the extremity ends of the wires to arrange them;

wherein when the moving direction of the wire dot printer head is as a main scanning direction, the guide holes of the extremity end guide are arranged along an arc curved only in direction of the sub-scanning direction so as to cause the arrangement positions in the main scanning direction to be made different.

2. A wire dot printer head according to claim 1, wherein the guide holes are classified into the groups of less number than the total number and the arrangement positions in the main scanning direction are made different in a unit of groups.

3. A wire dot printer head according to claim 1, wherein the guide holes arranged at both ends of the row and the guide holes arranged at the central part of the row are arranged at both sides with a center line of the sub-scanning direction passing through the center of the arrangement space of the cores being as a boundary.

4. A wire dot printer head according to claim 1, wherein a displacement space of the guide holes toward the main scanning direction is defined unequal.

5. A wire dot printer, comprising:

a sheet transferring passage for guiding a sheet;

transferring rollers for transferring the sheet in the sheet transferring passage;

a platen arranged along the sheet transferring passage;

a wire dot printer head; comprising a yoke;

a plurality of cores arranged in an annular form on the yoke;

a plurality of coils combined with the cores so as to fit the cores;

a plurality of armatures supported so as to be raised or lowered in respect to the cores;

a plurality of wires supported at the free ends of the armatures in such a way that they may be driven and displaced; and an extremity end guide having a plurality of guide holes for independently and slidably supporting the extremity ends of the wires and arranging them, wherein when the moving direction of the wire dot printer head is applied as a main scanning direction, the guide holes of the extremity end guide are arranged along an arc curved only in one direction of the sub-scanning direction so as to cause the arrangement positions in the main scanning direction to be made different;

wherein the wire dot printer head is opposite to the platen through the sheet transferring passage and movably held in a width direction of the sheet transferring passage; and means for applying voltage to coils driving respective wire while changing timing in response to the arrangement positions of the extremity ends of the wires in the main scanning direction.

6. A wire dot printer according to claim 5, wherein the guide holes are classified into groups of less number than the total number of the guide holes and the arrangement positions in the main scanning direction are made different in a unit of groups.

7. A wire dot printer according to claim 5, wherein the guide holes arranged at both ends of the row and the guide holes arranged at the central part of the row are arranged at both sides with the center line in the sub-scanning direction passing through the center of the arrangement space of the cores being as the boundary.

8. A wire dot printer according to claim 5, wherein a displacement space of the guide holes in the main scanning direction is defined unequal.

* * * * *